US008671868B2

(12) United States Patent
Shifferaw et al.

(10) Patent No.: US 8,671,868 B2
(45) Date of Patent: Mar. 18, 2014

(54) UNDERWATER VESSEL WITH ABOVE-WATER PROPULSION

(76) Inventors: Awsabe Shifferaw, Albany, CA (US); Tessema Dosho Shifferaw, Albany, CA (US)

( * ) Notice: Subject to any disclaimer, the term of this patent is extended or adjusted under 35 U.S.C. 154(b) by 423 days.

(21) Appl. No.: 12/696,266

(22) Filed: Jan. 29, 2010

(65) Prior Publication Data

US 2010/0186656 A1 Jul. 29, 2010

Related U.S. Application Data

(60) Provisional application No. 61/148,268, filed on Jan. 29, 2009.

(51) Int. Cl.
*B63G 8/08* (2006.01)

(52) U.S. Cl.
USPC ..... 114/357

(58) Field of Classification Search
USPC ..... 114/337, 339, 271, 272, 61.12, 61.14, 114/274, 61.13, 61.1; 440/1, 8, 37, 58; 244/49
See application file for complete search history.

(56) References Cited

U.S. PATENT DOCUMENTS

| | | | | | |
|---|---|---|---|---|---|
| 1,190,944 | A | * | 7/1916 | Orlando | 440/37 |
| 1,421,369 | A | * | 7/1922 | Ardo | 244/2 |
| 2,162,066 | A | * | 6/1939 | De Asis | 244/49 |
| 2,444,332 | A | * | 6/1948 | Briggs et al. | 244/49 |
| 2,914,014 | A | * | 11/1959 | Carl et al. | 114/281 |
| 3,092,060 | A | * | 6/1963 | Reid | 114/313 |
| 3,139,059 | A | * | 6/1964 | Hanford, Jr. | 114/273 |
| 4,350,114 | A | * | 9/1982 | Schirtzinger | 114/339 |
| 4,449,472 | A | * | 5/1984 | Meyer,Jr. | 114/274 |
| 4,775,340 | A | * | 10/1988 | Sundman | 440/8 |
| 4,819,576 | A | * | 4/1989 | Shaw | 114/248 |
| 5,704,309 | A | * | 1/1998 | Kohnen | 114/312 |
| 5,832,858 | A | * | 11/1998 | Ortlepp et al. | 114/221 R |
| 5,941,189 | A | * | 8/1999 | Johansson | 114/61.1 |
| 7,182,036 | B2 | * | 2/2007 | Levine | 114/274 |

* cited by examiner

*Primary Examiner* — S. Joseph Morano
*Assistant Examiner* — Anthony Wiest
(74) *Attorney, Agent, or Firm* — Edward S. Wright

(57) ABSTRACT

A vessel for transporting a payload through water having a body which travels below the surface of the water and carries the payload, fins extending laterally from the body below the surface of the water a telescoping tower which extends above the surface of the water from the body, a wing extending laterally above the water from an upper portion of the tower, engines mounted on the wing for propelling the body through the water, and propellers mounted on the under sides of the fins for lifting the vessel and holding the vessel in a raised position with the body at the surface of the water while loading and unloading the payload.

18 Claims, 4 Drawing Sheets

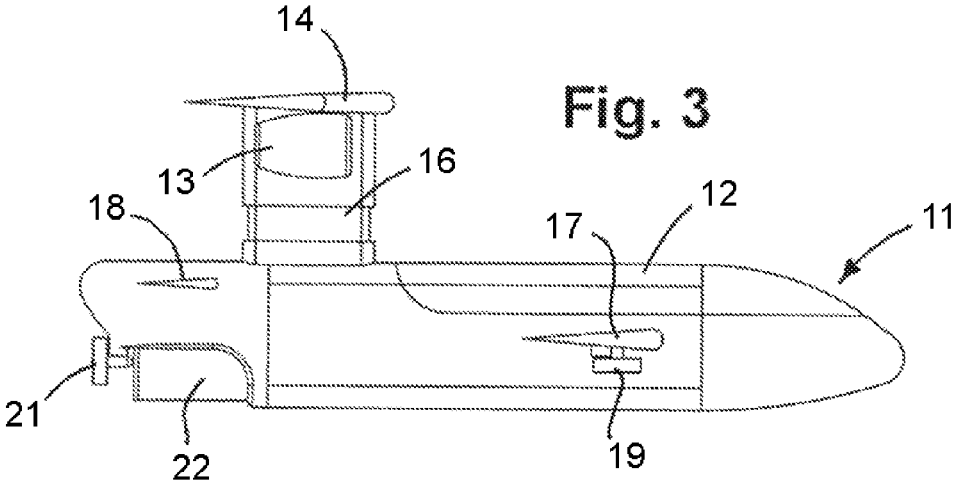
Fig. 3
Fig. 4
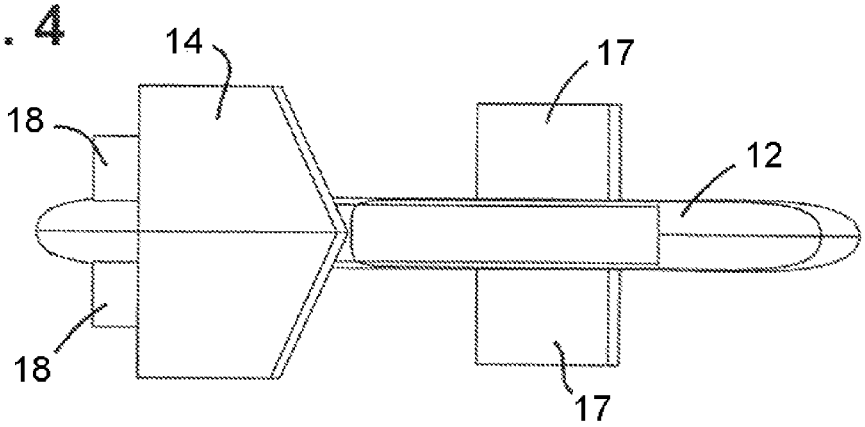
Fig. 5
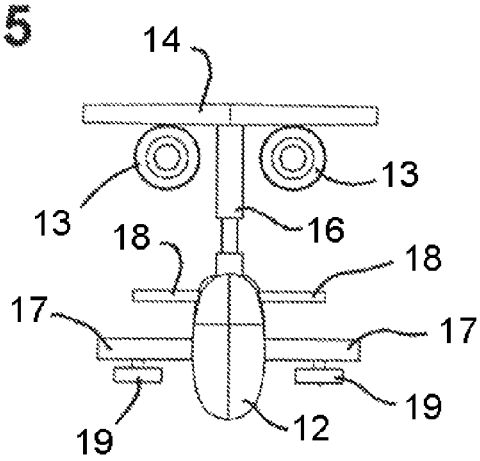

Fig. 6
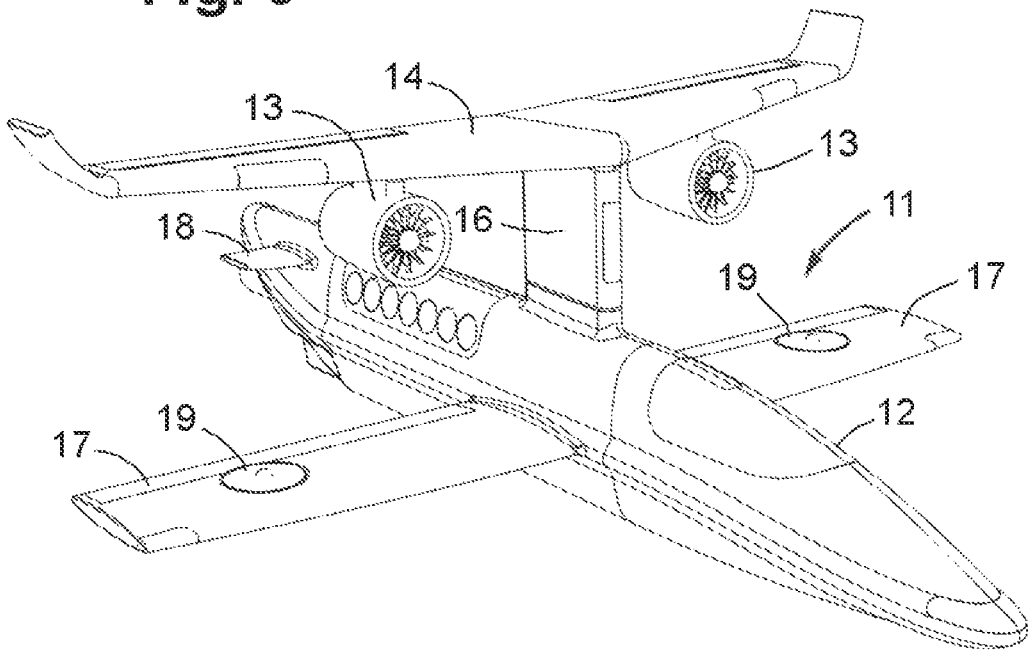
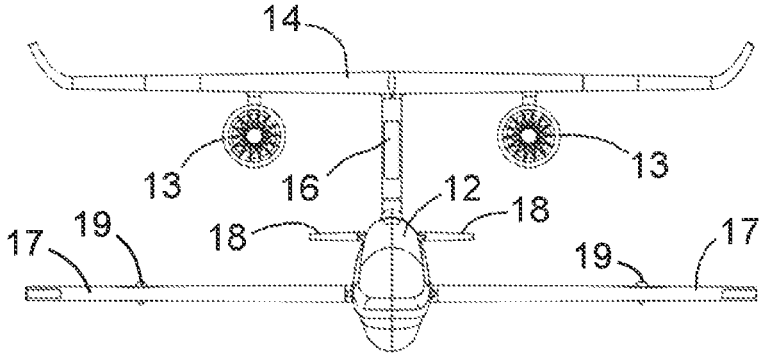
Fig. 7

Fig. 8
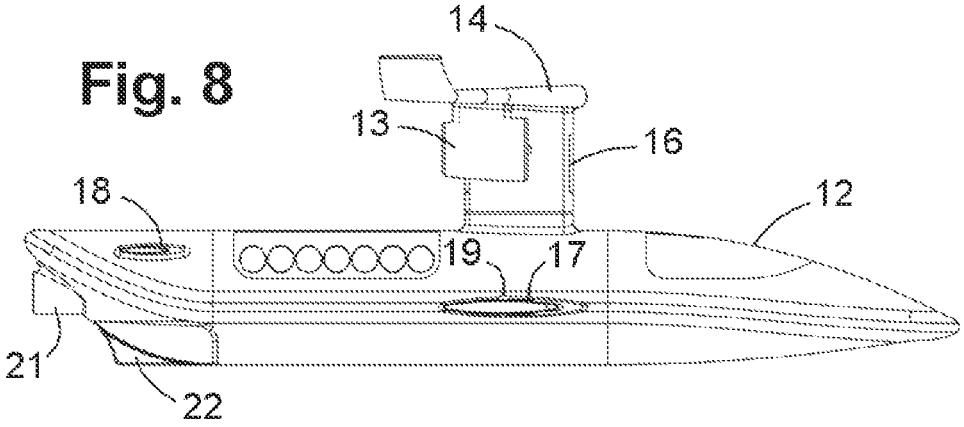
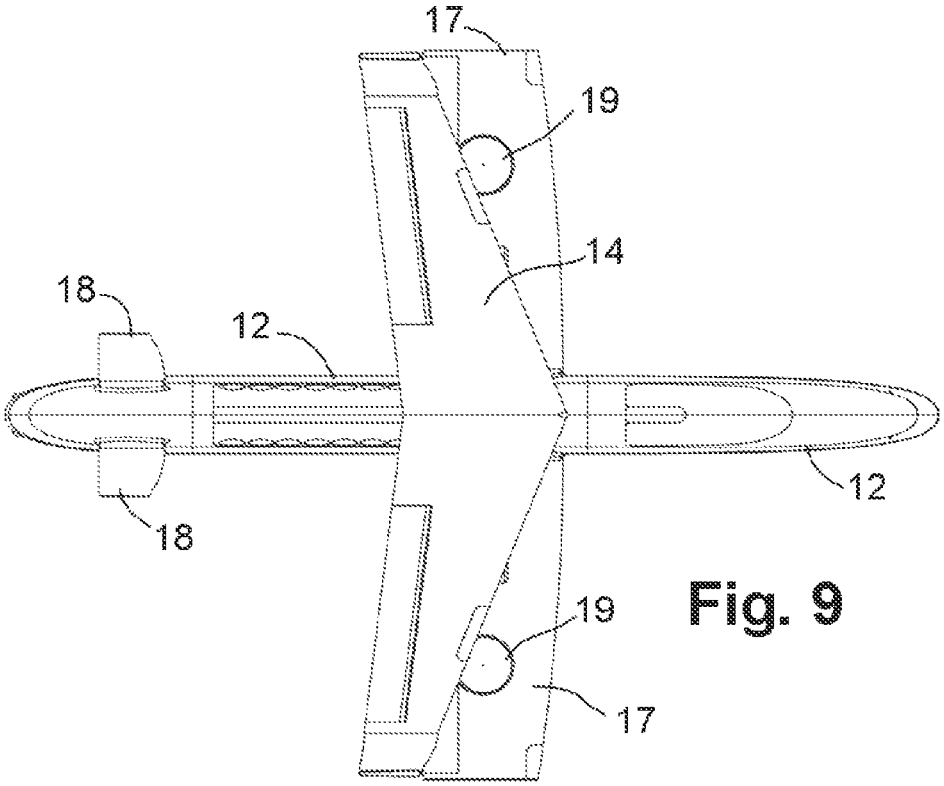
Fig. 9

UNDERWATER VESSEL WITH ABOVE-WATER PROPULSION

RELATED APPLICATIONS

Provisional Application No. 61/148,268, filed Jan. 29, 2009, the priority of which is claimed.

BACKGROUND OF THE INVENTION

1. Field of Invention

This invention pertains generally to marine vessels and, more particularly, to an underwater vessel with above-water propulsion.

2. Related Art

Transportation of people and cargo by boats or ships is relatively slow and inefficient because of the limited speeds at which such vessels can travel on the surface of water and the amount of fuel or energy they consume. While airplanes can generally travel much faster than boats, they are required to lift their payloads, which consumes additional fuel or energy. Moreover, many above water vessels or boats tend to hydroplane or fly, thereby losing control and becoming unsafe when speed is increased.

SUMMARY OF THE INVENTION

The invention provides a vessel that travels underwater with above-water propulsion. The vessel includes a body which travels below the surface of the water and carries people, cargo, or another payload, a tower which extends above the surface of the water from the body, and an engine mounted on the tower above the water for propelling the body through the water.

BRIEF DESCRIPTION OF THE DRAWINGS

FIG. 3 is a side elevational view of the embodiment of FIG. 1.

FIG. 4 is a top plan view of the embodiment of FIG. 1.

FIG. 5 is a rear elevational view of the embodiment of FIG. 1.

FIG. 6 is a front isometric view of another embodiment of an underwater vessel with above-water propulsion according to the invention.

FIG. 7 is a front elevational view of the embodiment of FIG. 6.

FIG. 8 is a side elevational view of the embodiment of FIG. 6.

FIG. 9 is a top plan view of the embodiment of FIG. 6.

DETAILED DESCRIPTION

Figure 1:
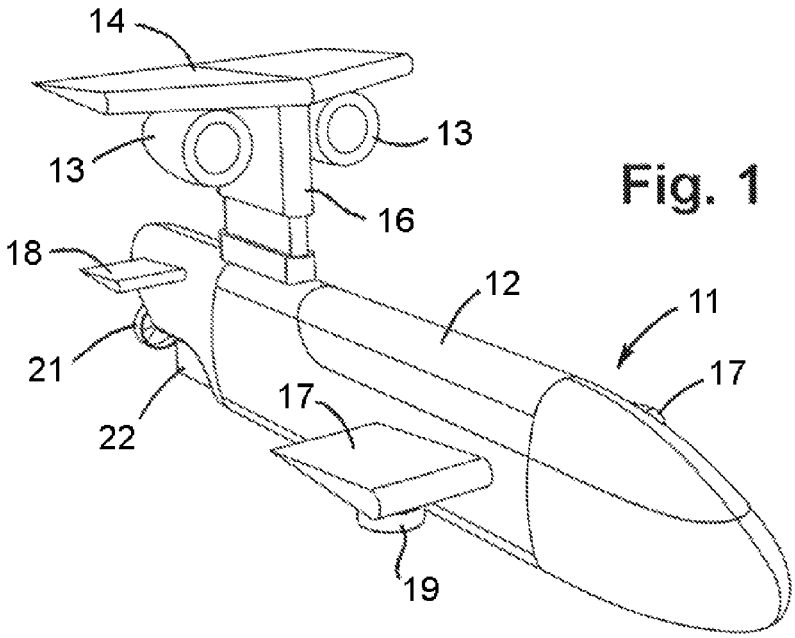
FIG. 1 is a front isometric view of one embodiment of an underwater vessel with above-water propulsion according to the invention.
Figure 2:
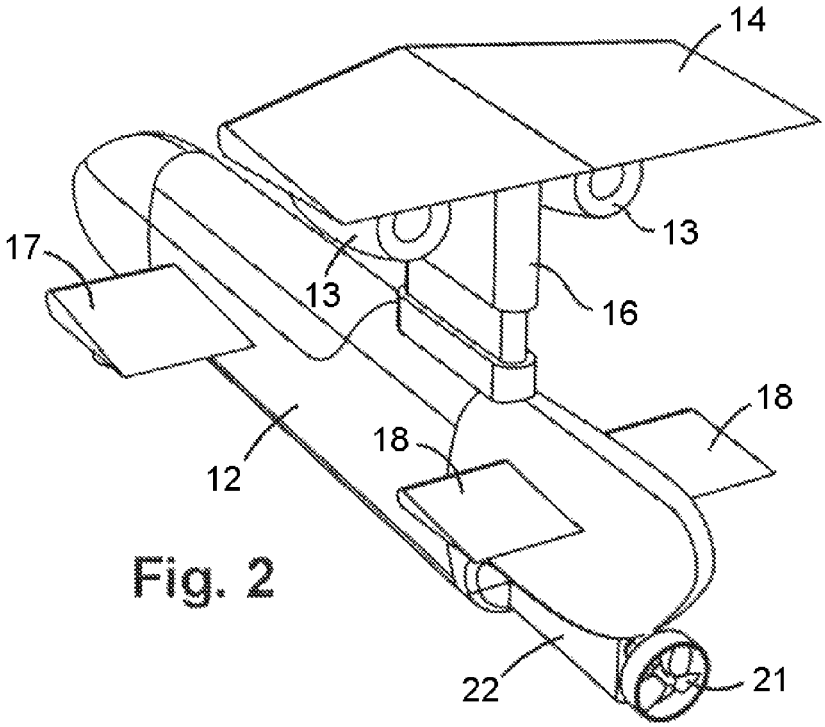
FIG. 2 is a rear isometric view of the embodiment of FIG. 1.

As illustrated FIGS. 1-5, the vessel 11 has an elongated, aerodynamically shaped body 12 which travels below the surface of water and holds the people, cargo, or other payload being transported. In the embodiment illustrated, the vessel is propelled by a pair of jet engines 13 which are attached to the under side of a wing 14 which travels through the air above the water and serves as a horizontal stabilizer toward the rear of the vessel. The wing is mounted to the body by a telescoping tower 16 which can be extended and retracted to position the engines at the desired height above the water, e.g. to provide the best thrust and to prevent water from getting into the air intakes of the engines. If desired, other types of above-water propulsion systems such as propellers or other types of aircraft engines can be used in place of, or in addition to, the jet engines.

Fins 17 extend laterally from opposite sides of the body approximately one-third of the way back from the front of the body toward the rear, and additional fins 18 extend laterally from the rear portion of the body. The fins function as stabilizers for the body as it travels through the water, and they can also be used as elevators to control the pitch and depth of the body in the water. Retractable propellers 19 are mounted on the under sides of fins 17 for lifting the vessel and holding it in a raised position for loading and unloading. Also, by reversing the direction of the propellers, the propellers can be used for driving the vessel down into the water. The buoyancy of can be increased and decreased like that of a submarine by pumping air into and out of chambers (not shown) onboard the vessel.

A propeller 21 and a rudder 22 are provided at the rear of the body for propelling the vessel at slower speeds and for steering the vessel in the water.

Viewing devices such as periscopes and/or cameras (not shown) can be mounted in or on the tower to provide a view of the area above the surface to the operator and/or others in the vessel below the surface.

The embodiment of FIGS. 6-9 is generally similar to the embodiment of FIGS. 1-5, and like reference numerals designate corresponding elements in the two embodiments. The embodiment of FIGS. 6-9 differs from the embodiment of FIGS. 1-5, however, in that the wing 14 and tower 16 are located in a more forward position relative to the body of the vessel. In the embodiment illustrated, they are positioned midway between the forward and aft ends of the vessel, but they can also be positioned even more forward, if desired. Having the wing and tower in a more forward or central position can avoid torque problems that might otherwise arise in some applications.

The vessel can be utilized in a wide variety of applications. Smaller vessels having a size of less than about 15 square meters (160 square feet) can, for example be designed and outfitted for rescue operations, fast transportation of human beings for both commercial and private use, fast delivery of cargo, and military use. Medium size vessels (15 to 200 square meters) and larger vessels (over 200 square meters) can also be utilized in similar applications with greater load carrying capacities, and the larger vessels can also be used in applications such as oil tankers for faster transportation of oil.

The vessel is also particularly suitable for use as a remotely controlled, unmanned vehicle or vessel in the water. It can be controlled from onboard aircraft or ships as well as from the shore. It can be activated when needed and left alone and unattended in the water for extended periods of time. It can, for example, be used advantageously by ships for protection against pirates and other enemies. One or more of the vessels accompanying a ship could be activated and deployed immediately to fend off the pirates or other enemy.

The vessel can be propelled with jet or rocket engines and used as a vehicle for surveillance, with cameras and radar and a loudspeaker for warning purposes. It can also be equipped with weapons and/or used like a torpedo. Fueling can be done either onshore or from a ship, and when deactivated, the vessel can easily be towed by a ship. Using the turbines, the vessel can be kept afloat with minimal use of fuel or energy, with the jets being fired only when needed.

The invention has a number of important features and advantages. Having the vessel travel underwater with above-water propulsion dramatically increases the speed at which the vessel can travel, decreases the amount of fuel or energy consumed, and also increases the safety of the vessel as compared with those that travel on the surface. It also makes it possible to transport heavy equipment, people and other heavy loads faster than by conventional ship without the added costs and safety concerns of flying.

It is apparent from the foregoing that a new and improved vessel for high speed transportation of people and other loads has been provided. While only certain presently preferred embodiments have been described in detail, as will be apparent to those familiar with the art, certain changes and modifications can be made without departing from the scope of the invention as defined by the following claims.

The invention claimed is:

1. A vessel for transporting people, cargo, or other payload through water, comprising: a body which travels below the surface of the water and carries the people, cargo, or other payload, a tower which extends from the body to a height above the surface of the water, an engine mounted on the tower above the surface of the water for propelling the body through the water, fins which extend laterally from the body for stabilizing the body in the water, and propellers mounted on the under sides of the fins for lifting the vessel and holding the vessel in a raised position with the body at the surface of the water while loading and unloading the people, cargo, or other payload.

2. The vessel of claim 1 wherein the fins include adjustable elevators for controlling pitch and depth of the body in the water.

3. The vessel of claim 1 including a wing which extends laterally from the tower and serves as a horizontal stabilizer for the vessel while traveling through the air above the water.

4. The vessel of claim 3 wherein the engine is attached to the wing.

5. The vessel of claim 1 wherein the tower is a telescoping tower which can be extended and retracted to position the engine at a desired height above the water.

6. The vessel of claim 1 wherein the propellers are reversible and can be used for driving the body of the vessel down into the water.

7. The vessel of claim 1 including a propeller and a rudder at the rear of the body for propelling the vessel at slower speeds and steering the vessel in the water.

8. The vessel of claim 1 wherein the engine is a jet engine.

9. The vessel of claim 1 including a propeller driven by the engine to propel the vessel through the water.

10. The vessel of claim 1 wherein operation of the vessel is remotely controlled.

11. A vessel for transporting a payload through water, comprising: a body which travels below the surface of the water and carries the payload within the body below the surface of the water, fins extending laterally from the body below the surface of the water, a telescoping tower which extends above the surface of the water from the body, a wing extending laterally from an upper portion of the tower above the surface of the water, engines mounted on the wing for propelling the body through the water, and propellers mounted on the under sides of the fins for lifting the vessel and holding the vessel in a raised position with the body at the surface of the water while loading and unloading the payload.

12. The vessel of claim 11 wherein the fins extend from both forward and aft portions of the body.

13. The vessel of claim 11 wherein the fins include adjustable elevators for controlling pitch and depth of the body in the water.

14. The vessel of claim 11 wherein the propellers are reversible and can be used for driving the body of the vessel down into the water.

15. The vessel of claim 11 including a propeller and a rudder at the rear of the body for propelling the vessel at slower speeds and steering the vessel in the water.

16. The vessel of claim 11 wherein the engines are jet engines.

17. The vessel of claim 11 including propellers driven by the engines to propel the vessel through the water.

18. The vessel of claim 11 wherein operation of the vessel is remotely controlled.

* * * * *